United States Patent [19]

Kern

[11] Patent Number: 4,547,926

[45] Date of Patent: Oct. 22, 1985

[54] ROLLER TRAY WITH COVER

[76] Inventor: Gilbert G. Kern, 515 N. Victory Blvd., Burbank, Calif. 91502

[21] Appl. No.: 558,374

[22] Filed: Dec. 5, 1983

[51] Int. Cl.[4] ..... B44D 3/12

[52] U.S. Cl. ..... 15/257.06; 220/4 B

[58] Field of Search ..... 15/257.05, 257.06; 220/4 B, 4 E, 85 CH, 23, 335; 206/1.7; 134/6

[56] References Cited

U.S. PATENT DOCUMENTS

| | | | |
|---|---|---|---|
| 643,855 | 2/1900 | Williamson | 15/257.05 |
| 3,152,716 | 10/1964 | Feldhahn | 220/4 E |
| 3,266,655 | 8/1966 | Trunk | 220/4 E |
| 3,850,298 | 11/1974 | Jolly | 15/257.06 |
| 4,010,866 | 3/1977 | McClane | 15/257.06 X |
| 4,200,949 | 5/1980 | Heniff, Jr. | 15/257.06 |
| 4,445,250 | 5/1984 | Seidl | 15/257.06 |

*Primary Examiner*—Edward L. Roberts

*Attorney, Agent, or Firm*—Bernard P. Drachlis

[57] ABSTRACT

Paint roller tray has closed bottom and sides which terminate in upper periphery. Hinged cover seals against the periphery of the sides to exclude air to inhibit drying of the paint. Preferably, the cover has retainers on the inside for holding paint rollers and/or brushes which have been used with the paint in the tray so that those painting implements also do not dry out. The cover is hinged on the tray so that it is quickly available for closing.

8 Claims, 5 Drawing Figures

ROLLER TRAY WITH COVER

BACKGROUND OF THE INVENTION

This invention is directed to a roller tray with hinged cover wherein the cover can swing to the closed position to seal on the tray to maintain material in the tray in fresh condition.

Paint roller trays are well-known. Such trays have sides and bottoms, with a reservoir in a portion of the bottom and a further portion of the bottom being sloped so that a paint roller can be dipped in the paint in the reservoir and rolled out on the sloped bottom. Rollers for such purposes are also well-known. In addition, conventional paint brushes are sometimes used with such a paint roller tray, with the brushes usually used for edging and filling deeper cracks and holes. Such a paint tray may also be used with other paint applying devices such as paint pads.

These conventional paint roller trays and associated implements are used by pouring paint in the tray and employing the various implements to remove the paint from the tray and apply it to the surface being painted. Quite often the job is interrupted before the painting is complete. Even a lunch break causes stiffening of most paints to the point where the paint roller tray and the painting implements must be cleaned. Such is definitely true for any paint on an over-night break in the painting operation. The cleaning of the paint roller tray and the painting implements is both time-consuming and wasteful of paint. A considerable amount of time is necessary to properly return the paint from the paint roller tray back into the paint can, and, thereupon, clean the remaining paint from the paint roller tray. Some residual paint can usually be recovered from a roller and returned to the paint can, but little paint can be recovered from a painting pad or a paint brush. Therefore, that which remains must be washed out. Furthermore, there is the cost of the solvent employed in the cleaning. Thus, there is a need for a roller tray which will preserve solvent-containing material therein over a short time to avoid the need for cleaning the tray from one shift to the next.

SUMMARY OF THE INVENTION

In order to aid in the understanding of this invention, it can be stated in essentially summary form that it is directed to a roller tray with cover wherein the tray has a bottom and contiguous sides which terminate in an upper periphery. A hingedly mounted cover swings down against this periphery to enclose and seal the tray to maintain solvent-containing material therein and material applying implements therein away from conditions which would dry out the material.

It is, thus, an object and advantage of this invention to provide a roller tray having a hinged cover thereon for protecting material in the tray against drying out so that the cover may be hinged open for a painting shift and may be hinged closed on the tray between shifts to avoid drying out of the material in the tray and avoid cleaning of the tray between shifts.

It is another object and advantage of this invention to provide a roller tray with a hinged cover configured to removably retain therein application implements so that when the cover is closed, implements removably secured to the interior of the cover and material in the tray are positioned to avoid drying out between shifts.

It is a further object and advantage to provide a roller tray and hinged cover which is particularly useful with paint and paint applying implements.

Other objects and advantages of this invention will become apparent from a study of the following portion of this specification, the claims and the attached drawings.

DESCRIPTION OF THE PREFERRED EMBODIMENT

Figure 1:
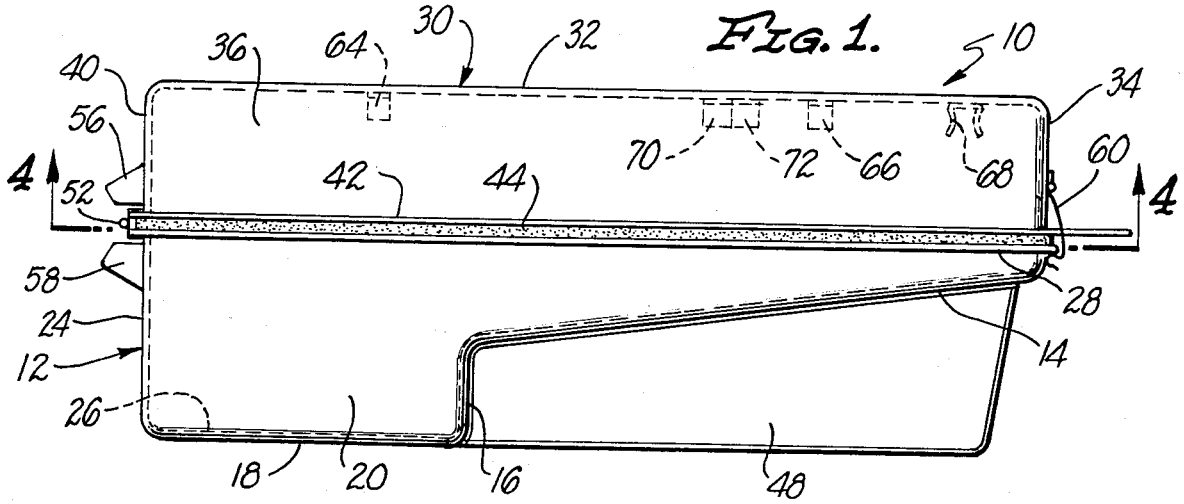
FIG. 1 is a side-elevational view of the roller tray with cover in accordance with this invention.
Figure 2:
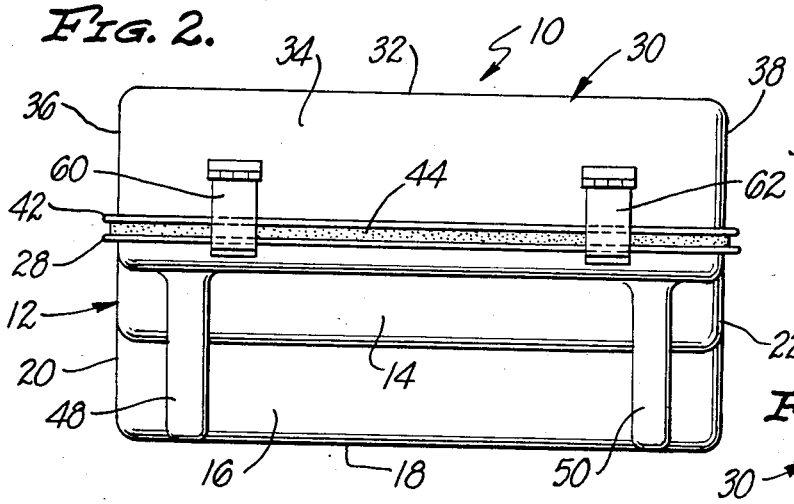
FIG. 2 is an elevational view of the roller tray with cover as seen from the right end of FIG. 1.
Figure 3:
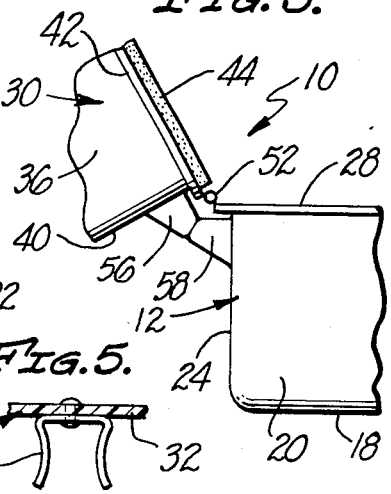
FIG. 3 is an enlarged detail of the hinge portion between the roller tray and its cover, with parts broken away and shown in the open position.

The roller tray with its hinged cover in accordance with this invention is generally indicated at 10 in FIGS. 1, 2 and 3. The roller tray is generally indicated at 12 in the same FIGS. The roller tray with its hinged cover is particularly described for use with paint, for it is expected it will see its greatest use with paint. However, it is clear that it is equally useful with other solvent-containing material, such as some adhesives and cements. Paint roller tray 12 has a sloping bottom 14 extending downward to the left in FIG. 1 to a point where side 16 extends downwardly to flat bottom 18. Left and right sides 20 and 22 and back side 24 define a well 26 in which paint can be stored for use. A paint roller can be dipped into paint in the well and rolled out on the top side of the sloping bottom 14. The sides of paint roller tray 12 terminate at an upper peripheral flange 28. Flange 28 has a planar top surface, as is seen in FIG. 3.

Cover 30, seen in FIGS. 1, 2, 3 and 4, has a top 32 and four side walls. As seen in FIG. 2, there is front side wall 34, left and right side walls 36 and 38 and back side wall 40. The side walls are formed contiguously with top 32 to form an enclosed cover. The side walls extend downward to top flange 42, which is planar and lies parallel to and faces peripheral flange 28. Seal ring 44 is a soft seal, preferably made of elastomeric, resilient tubing or a closed cell elastomeric foam material having a continuous skin thereon. The seal ring 44 is adhesively attached to top flange 42. Thus, all sealing between flanges 28 and 42 is by means of the seal ring 44.

The paint roller tray 12 and the cover 30 are preferably each integrally molded of suitable synthetic polymer composition material of such nature as to be resistant to the paint which will be used in the paint roller tray with cover 10. Each is fully closed except for the open faces which face each other and are sealed together by seal ring 44. Seal ring 44 is also suitably resistant to the paint material. During the molding, feet 48 and 50, see FIG. 2, are molded integrally with bottom 14 and side 16 and lie in the same plane as flat bottom 18 to provide support of the paint roller tray and cover 10 upon a flat surface.

Hinges 52 and 54 are secured to the top and bottom. Stops 56 and 58 are molded onto cover 30 and tray 12 to limit the opening of the cover 30, as is shown in FIG. 3.

As is seen in FIG. 3, when open, seal ring 44 rises with the cover to minimize its contact with the paint to thereby minimize cleaning of the seal ring. As previously discussed, when painting is complete, the cover is hinged down into the closed position on top of tray 12. The hinges are positioned so that when the cover swings closed, the seal ring is compressed. The hinges act as a vise to compress the seal ring. The cover is retained in the closed position by spring latches 60 and 62 which are hinged on the cover and resiliently engage beneath peripheral flange 28 to compress seal ring 44 to maintain the closed seal around the paint roller tray with respect to its cover 30.

Figure 5:
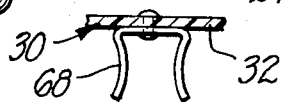
FIG. 5 is an enlarged detail of one of the retainers secured under the cover, with parts broken away and parts taken in section.
Figure 4:
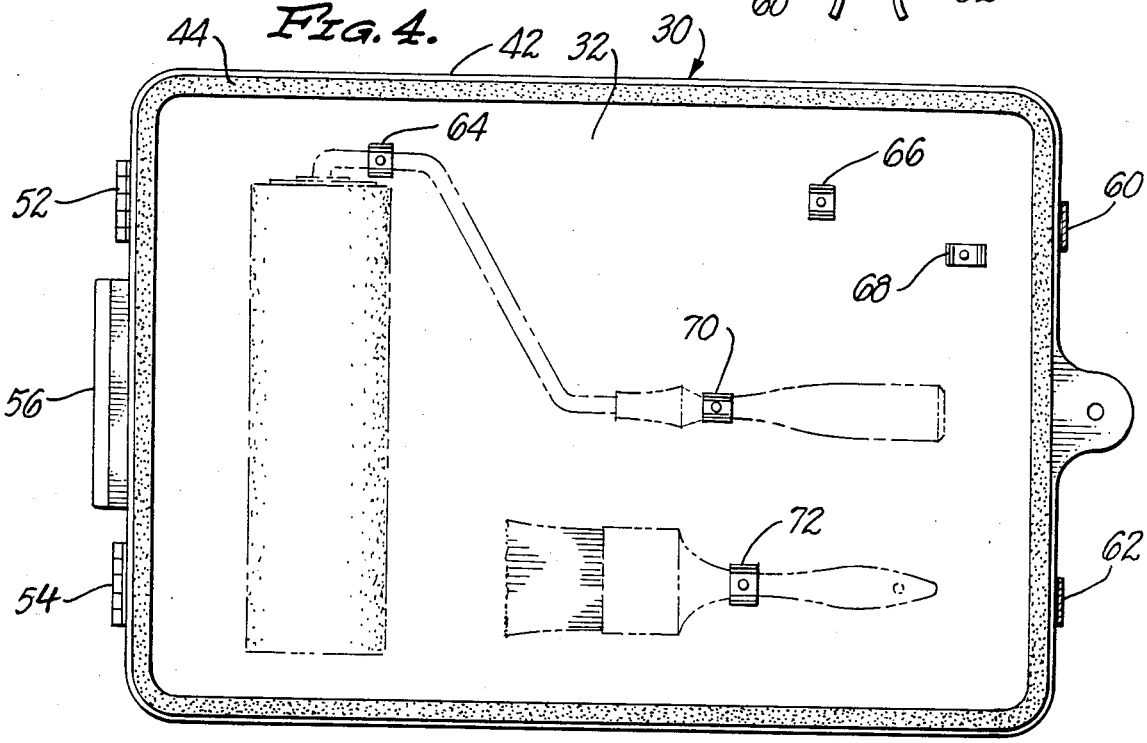
FIG. 4 is an upward view into the underside of the cover, as seen generally along the line 4—4 of FIG. 1.

FIG. 4 is an upward view into the cover, as seen upwardly in FIG. 1. A plurality of clips 64, 66 68, 70 and 72 are secured underneath the cover. FIG. 5 is a particular detail of the clip 68 and shows it riveted through top 32. The configuration of the clips may vary to accommodate different devices. As seen in FIG. 4, the clips 64 and 70 are configured and positioned for the retaining of a conventional paint roller within cover 30 up against top 32. Similarly, clip 72 is configured and positioned for retaining a paint brush. Various other clips may be positioned and sized for other brushes, paint rollers or painting pad implements. While the clips are shown as riveted in place, any other proper attachment means can be used.

In use, cover 30 is hinged to the raised position and paint or other solvent containing material is poured into well 26. A roller, brush and/or a paint pad or other painting implement may be dipped into the paint into the well 26. The implement may be brushed off against sloping bottom 14, and the paint remaining on the implement can be applied to the surface being painted. When the painting shift is done, the painting implements are attached, without cleaning, to the clips fastened to the underside of the top of the cover. Thereupon, the cover is hinged closed and latched to completely seal off the interior space defined within the paint roller tray and cover. Seal ring 44 seals the joints between the tray and the cover, and there are no other openings. In this condition, the solvent in the paint soon saturates the entire volume and the paint cannot further dry out. Therefore, the paint remaining in the painting implements does not stiffen and the paint in well 26 does not dry out. When the cover is closed over the paint roller tray for a lunch break, for an over-night or for a weekend, the remaining paint and the paint saturated painting implements remain fresh and ready for immediate use. Thus, the time of cleanup is saved, the solvent which would have been used in cleanup is saved, and the paint which would have been lost in cleanup is saved.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A roller tray with cover;

said roller tray having a bottom and having sides to form an upwardly open but otherwise closed container having an upper upwardly directed peripheral surface, said roller tray being molded as one piece of synthetic polymer composition material;

said cover having a flat top and having downwardly directed side walls having a downwardly directed surface so that said cover is closed except for its downwardly facing opening between said side walls, said side walls being positioned so that its downwardly directed surface faces the upwardly directed peripheral surface of said sides of said tray, said cover being molded as one piece of synthetic polymer composition material, said cover being hingedly mounted on said tray, a stop molded into at least one of said roller tray and cover to limit the angular hinge opening of said cover with respect to said roller tray; and a resilient seal between said surface on said tray and on said cover so that said flat-topped cover can be hingedly raised with respect to said tray to selectively provide access to said tray and selectively hinged down to cover, enclose and seal said tray to inhibit drying of material within said tray.

2. A roller tray with cover;

said roller tray having a bottom and having sides to form an upwardly open but otherwise closed container having an upper upwardly directed peripheral surface, said roller tray being molded as one piece of synthetic polymer composition material;

said cover having a flat top and having downwardly directed side walls having a downwardly directed surface so that said cover is closed except for its downwardly facing opening between said side walls, said side walls being positioned so that its downwardly directed surface faces the upwardly directed peripheral surface of said sides of said tray, said cover being molded as one piece of synthetic polymer composition material, said cover being hingedly mounted on said tray a stop molded into at least one of said roller tray and cover to limit the angular hinge opening of said cover with respect to said roller tray;

a resilient seal between said surfaces on said tray and on said cover so that said flat-topped cover can be hingedly raised with respect to said tray to selectively provide access to said tray and selectively hinged down to cover, enclose and seal said tray to inhibit drying of material within said tray; and a latch interengaged between said cover and said roller tray in a position away from said hinge to releaseably retain said cover on said roller tray in a sealed position thereon.

3. A roller tray with cover;

said roller tray having a sloped bottom and having sides to form an upwardly open but otherwise closed container having an upper upwardly directed peripheral surface, said roller tray being molded as one piece of synthetic polymer composition material;

said cover having a flat top and having downwardly directed side walls having a downwardly directed surface so that said cover is closed except for its downwardly facing opening between said side walls, said side walls being positioned so that its downwardly directed surface faces the upper upwardly directed peripheral surface of said sides of said tray, said cover being hingedly mounted on said tray, said cover being molded as one piece of synthetic polymer composition material;

a stop molded into at least one of said roller tray and cover to limit the angular hinge opening of said cover with respect to said roller tray; and a resilient seal between said surfaces on said tray and on said cover so that said cover can be hingedly raised with respect to said tray to selectively provide access to said tray and selectively hinged down to cover, enclose and seal said tray to inhibit drying of material within said tray.

4. The roller tray with cover of claim 3 wherein a latch is interengaged between said cover and said roller tray in a position away from said hinge to releasably retain said cover on said roller tray in a sealed position thereon.

5. A roller tray with cover;

said roller tray having a bottom and having sides to form an upwardly open but otherwise closed container having an upper upwardly directed peripheral surface, said roller tray being molded as one piece of synthetic polymer composition material;

said cover having a flat top and having downwardly directed side walls having a downwardly directed surface so that said cover is closed except for its downwardly facing opening between said side walls, said side walls being positioned so that its downwardly directed surface faces the upwardly directed peripheral surface of said sides of said tray, said cover being hingedly mounted on said tray, said cover being molded as one piece of synthetic polymer composition material, clips secured within said cover, said clips being configured to releasably retain implements within said cover;

a stop molded into at least one of said roller tray and cover to limit the angular hinge opening of said cover with respect to said roller tray;

a resilient seal between said surfaces on said tray and on said cover so that said cover can be hingedly raised with respect to said tray to selectively provide access to said tray and selectively hinged down to cover, enclose and seal said tray to inhibit drying of material within said tray; and a latch interengaged between said cover and said tray in a position away from said hinge to releasably retain said cover on said roller tray in a sealed position thereon.

6. A roller tray with cover;

said roller tray comprising a one-piece molded tray having side walls, a sloping bottom and a well therein, feet molded beneath said sloping bottom to extend even with the bottom of said well to define a bottom support plane, said side walls and said bottom defining an open top and otherwise closed roller tray, a peripheral flange at the top of said sides of said roller tray, the top of said peripheral flange defining a sealing surface;

a cover molded in one piece and having a substantially flat top and integral side walls, said side walls terminating in a top flange facing said peripheral flange on said roller tray;

a resilient seal between said flanges so that said cover can be sealed with respect to said roller tray;

hinges attached to one side of said roller tray and to the adjacent side wall of said cover, said hinges being positioned so that when said cover is moved into closed position over said roller tray, said cover compresses said seal;

a stop molded on at least one of said roller tray and said cover, said stop limiting opening hinge movement of said cover with respect to said roller tray; and releaseable latch positioned away from said hinges to releasably hold said cover in sealed position with respect to said roller tray.

7. A roller tray with cover;

said roller tray comprising a one-piece molded tray having side walls, a sloping bottom and a well therein, feet molded beneath said sloping bottom to extend even with the bottom of said well to define a bottom support plane, said side walls and said bottom defining an open top and otherwise closed roller tray, a peripheral flange at the top of said sides of said roller tray, the top of said peripheral flange defining a sealing surface;

a cover molded in one piece and having a substantially flat top and integral side walls, said side walls terminating in a top flange facing said peripheral flange on said roller tray;

a resilient seal between said flanges so that said cover can be sealed with respect to said roller tray;

hinges attached to one side of said roller tray and to the adjacent side wall of said cover, said hinges being positioned so that when said cover is moved into closed position over said roller tray, said cover compresses said seal;

a stop molded on at least one of said roller tray and said cover, said stop limiting opening hinge movement of said cover with respect to said roller tray; and a releasable latch positioned away from said hinges to releaseably hold said cover in sealed position with respect to said roller tray; and clips secured within said covers, said clips being positioned and configured to releasably retain applying implements therein so that material in said roller tray and implements having material therein can be enclosed within said roller tray by hinged closing of said cover to seal the interior space to inhibit evaporation of solvent to thus inhibit drying of the material in the roller tray and in the applying implements.

8. The method of painting employing a paint roller tray having a hinged sealed cover thereon comprising the steps of:

opening the paint roller tray by raising the sealed cover by swinging it on its hinges;

placing paint within said paint roller tray;

removing paint from the paint roller tray by wetting a paint implement with paint and applying the paint on the painting implement onto a surface to be painted;

at the end of a working period placing the paint wetted painting implement within the paint roller tray by attaching the wetted painting implement to releasable securing clips within the cover; and hinging closed the cover on the pain roller tray to hold the painting implement out of the paint within the paint roller tray by swinging the cover down on its hinges and sealing the cover with respect to the paint roller tray to inhibit drying out and hardening of the paint in the paint roller tray and in the painting implement.

* * * * *